United States Patent [19]

Coster

[11] Patent Number: 4,742,501

[45] Date of Patent: May 3, 1988

[54] TIME DISPLAY APPARATUS

[75] Inventor: Charles S. Coster, Cambridge, Mass.

[73] Assignee: By Design Corp., Cambridge, Mass.

[21] Appl. No.: 80,460

[22] Filed: Jul. 31, 1987

[51] Int. Cl.[4] ..... G04C 19/00; G04C 17/02

[52] U.S. Cl. ..... 368/82; 368/107; 368/240

[58] Field of Search ..... 368/82–84, 368/107–113, 239–242

[56] References Cited

U.S. PATENT DOCUMENTS

| | | | |
|---|---|---|---|
| D. 87,769 | 3/1936 | Horwitt . | |
| D. 178,769 | 9/1956 | Doerr . | |
| D. 217,003 | 3/1970 | Windebank . | |
| D. 229,436 | 11/1973 | Chow . | |
| D. 242,694 | 12/1976 | Thompson et al. . | |
| 2,001,195 | 4/1935 | Horwitt et al. . | |
| 2,157,540 | 5/1938 | Horwitt . | |
| 2,536,206 | 1/1951 | Newhouse . | |
| 2,953,776 | 9/1960 | Blutman et al. . | |
| 3,786,624 | 1/1974 | Uchiyama . | |
| 4,081,953 | 4/1978 | Crutcher . | |
| 4,121,415 | 10/1978 | Crutcher et al. | 368/240 |
| 4,312,055 | 1/1982 | Noble | 368/29 |
| 4,407,587 | 10/1983 | Fujita | 368/108 |
| 4,745,243 | 5/1956 | Schumacher . | |

FOREIGN PATENT DOCUMENTS

| | | |
|---|---|---|
| 827771 | 1/1952 | Fed. Rep. of Germany . |
| 1249773 | 9/1967 | Fed. Rep. of Germany . |
| 1139119 | 2/1957 | France . |
| 282774 | 5/1952 | Switzerland . |
| 324250 | 9/1957 | Switzerland . |

*Primary Examiner*—Vit W. Miska

*Attorney, Agent, or Firm*—Wolf, Greenfield & Sacks

[57] ABSTRACT

A time display apparatus including a display having a digital display portion and a peripheral analog display portion comprised of a plurality of display segments. Display control means is provided for controlling the digits of the digital display and the segments of the analog display. A manual selection mode switch is used to provide at least two separate modes of control including a normal time mode in which the digital display registers hours and the analog display registers minutes, and a count mode in which the digital display registers minutes and the analog display registers seconds. The count mode can be separated into two separate modes, one for counting up and one for counting down. Furthermore, there is provided an alarm mode associated with the normal time mode.

20 Claims, 2 Drawing Sheets

TIME DISPLAY APPARATUS

BACKGROUND OF THE INVENTION

The present invention relates in general to a time display apparatus, and pertains, more particularly, to a combined digital and analog display in which the digital portion of the display may represent hours or minutes and the analog portion of the display may represent minutes or seconds. Even more particularly, the present invention relates to a time display apparatus having manual control means including means for setting different modes of operation thereof including, inter alia, a normal time mode and a count mode.

It is an object of the present invention to provide an improved time display apparatus, and in particular such an apparatus that has both a digital display and an analog display. Another object of the present invention is to provide an improved time display apparatus and in which the digital display may be used for displaying hours while the analog display is used for displaying minutes.

A further object of the present invention is to provide an improved display apparatus as in accordance with the preceding apparatus and in which seconds display also occurs by sequential illumination of the segments of the analog display.

Still another object of the present invention is to provide an improved time display apparatus that is capable of multi-mode operation including a normal time mode of operation as well as a count mode of operation.

Still a further object of the present invention is to provide a time display apparatus as in accordance with the preceding object and in which the count mode may be separated into both a count up mode as well as a count down mode of operation.

Another object of the present invention is to provide a time display apparatus as in accordance with the preceding object and in which there is furthermore provided for an alarm mode of operation in which an alarm can be started or stopped.

Still another object of the present invention is to provide a time display apparatus as in accordance with the preceding objects and in which there is further provided an audible alarm that can be used in association with both the alarm mode of operation as well as the count mode or modes of operation.

Another object of the present invention is to provide a time display apparatus that is simple in construction, that is substantially totally electronic in nature, that requires little or no maintenance, and that can be readily operated even by an unskilled person.

SUMMARY OF THE INVENTION

To accomplish the foregoing and other objects, features and advantages of the invention there is provided a time display apparatus that is comprised of a display means. This display means may be in the form of a liquid crystal display and is basically separated into a digital display portion and an analog display portion. The digital display has two digits. The first digit may be a two segment digit that can represent the numeral "1". The second digit may be a seven segment digit that can represent decimal digits. The analog display is comprised of a plurality of display segments preferably circumferentially disposed about the digital display and used for the purpose of either minute or second display.

The two digit digital display on the other hand is used for the purpose of display of either hour or minute designations. In connection with the analog display, this is preferably comprised of sixty display segments. Twelve of the sixty display segments, at five segment intervals, are visually distinguishable from the remaining segments. This visual distinction may be realized by making the twelve separated segments longer than the remaining segments.

The time display apparatus of the present invention also comprises display control means. In the preferred embodiment described in further detail hereinafter, the primary control means is in the form of a timing circuit or chip to be identified hereinafter. The display control means includes means for controlling the digits of the digital display as well as means for controlling the plurality of display segments of the analog display. Manual selection mode means is provided for controlling the display control means to provide at least two separate modes of control including a normal time mode in which the digital display registers hours and the analog display registers minutes, and a count mode in which the digital display registers minutes and the analog display registers seconds.

The means for controlling the analog display may include means that is operable in the normal time mode, for sequentially illuminating the display segments at a seconds rate. In this way, in the normal time mode, the peripheral analog segments may be used on a minute-by-minute basis to indicate minutes of time and at the same time are sequentially illuminated at a faster seconds rate to indicate the passage of seconds. This is all carried out with the use of the single analog display. As far as the seconds indication is concerned, hereinafter from time-to-time referred to as a seconds sweep, this is preferably carried out by means of illuminating display segments at the seconds rate that are unselected by the minutes registration while at the same time extinguishing display segments that are selected by the minutes registration.

In accordance with a further feature of the present invention the means for controlling the analog display may include means, operable in the normal time mode, for selecting only one of the twelve segments that indicate a five minute interval, and for selecting, in addition, remaining segments only after the selected segment to indicate time intervals between the five minute interval.

In accordance with the present invention there is also provided manual control in addition to the manual selection mode means. There is a manual digital selection means that is operable to change the digital display under user control. There is also manual analog selection means that is operable to change the analog display under user control. For example, either of the displays can be incremented by switch depression. For example, in the normal time mode of operation the digital selections switch may be used to advance the digitally displayed hours while the analog selection switch may be used to advance the segments indicating minutes. In this way the time display apparatus can have its time set. Lastly, there is a manual start/stop selection means that is operable to initiate the counting in the count mode as well as controlling other functions to be described in further detail hereinafter.

The manual selection mode means further includes an alarm mode in which an alarm time may be set and furthermore enabled from the manual start/stop selection means. One can go into the alarm mode to set the alarm and then resume normal time operation. If the alarm is set then at the appropriate time the audible signal is generated and it is adapted to continue for a predetermined interval such as five minutes. The audible alarm may be reset so that it ceases by further operation of the start/stop selection means.

BRIEF DESCRIPTION OF THE DRAWINGS

Numerous other objects, features and advantages of the invention should now become apparent upon a reading of the following detailed description taken in conjunction with the accompanying drawings, in which.

DETAILED DESCRIPTION

Figure 1:
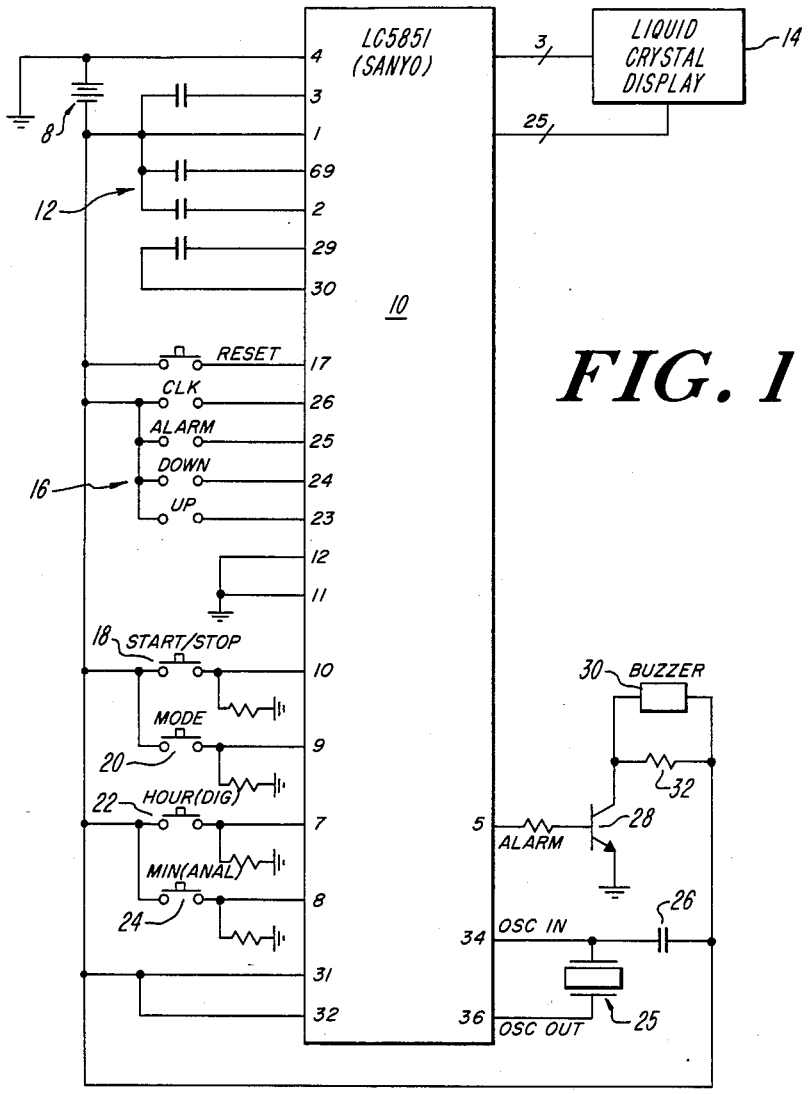
FIG. 1 is a circuit diagram of the time display apparatus of the present invention employing a control circuit tip that is in particular programmed in accordance with the concepts of the present invention.
Figure 2:
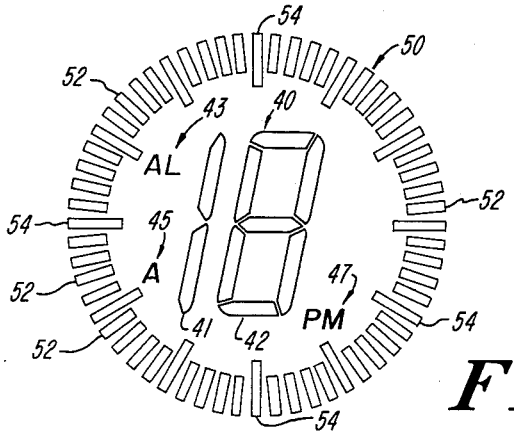
FIG. 2 is an illustration of the preferred display of the present invention separated into a centrally disposed two-digit digital display and a sixty segment analog display disposed circumferentially about the digital display.

Reference is now made to the drawings herein and in particular to FIGS. 1 and 2. FIG. 1 is an illustration of the circuit diagram that is used in accordance with the present form of time display control. FIG. 2 is an illustration of a preferred arrangement for the display itself. In connection with the circuit diagram of FIG. 1, it is noted that the main control is provided by the circuit chip 10 which is a standard timing chip identified as Sanyo No. LC5851. For a complete description of the operation in accordance with this apparatus refer hereinafter to the description relating to the different modes of operation. Also, reference is made herein to the program set forth in appendix A which is attached hereto.

In FIG. 1 the time control chip 10 is powered from the battery B, which may be a three volt battery. At certain inputs to the circuit 10, there are provided a series of capacitors illustrated generally at 12 in FIG. 1. These capacitors are employed to set-up the proper drive voltages for the display. In this connection refer in FIG. 1 to the liquid crystal display 14 that is controlled from the chip 10.

In FIG. 1 below the capacitors illustrated at 12, there are a series of test switches illustrated generally at 16. These switchs are used only for the purpose of testing and are thus not discussed in any great detail herein.

There are four switches that are the primary manual control in accordance with the present invention. These switches are illustrated coupling to terminal 7–10 of the circuit chip 10. These switches include a start/stop switch 18, a mode switch 20, a digital display control switch 22, and an analog display control switch 24. In the illustration of FIG. 1 the switch 22 is also designated as a "hour" switch and the switch 24 is designated as a "minute" switch. However, these designations only apply in the normal time mode of operation and thus the designations of digital and analog are more appropriate.

The basic reference oscillator for the circuit chip 10 is illustrated in FIG. 1 at 25 and comprises a crystal oscillator. Also illustrated is a capacitor 26 coupling to one side of the battery B.

The alarm is provided by means of a transistor 28 and associated buzzer 30 as well as an associated resistor 32 disposed across the buzzer 30. This arrangement provides the desired audible alarm which is excited in the normal time mode of operation when the alarm goes off. The buzzer 30 is also used as an audible alarm in both the count up and count down modes of operation.

The liquid crystal display 14 is of conventional design and as noted in FIG. 1 has three lines coupling on one side of the display and 25 lines coupling on the other side. The display is a tri-plex display and with the total of these control lines can control up to 75 different display segments.

With respect to the display, reference may now be made to FIG. 2. FIG. 2 illustrates a digital portion of the display at 40 and an analog portion of the display at 50. The digital display may be comprised of two separate digits 41 and 42. The digit 41 can either be illuminated or not and when it is illuminated its two segments indicate a "1". The other digit 42 is represented by a seven-segment display and can illustrate any of the usual decimal numbers 0–9.

The analog display is comprised of a plurality of display segments 52 that are disposed circumferentially about the digital display and are used for the purpose of displaying minutes in the normal time mode of operation or for displaying seconds in the count modes of operation. Furthermore, these segments, which number sixty can also be sequentially pulsed to provide a sweeping action indicating a combination of minutes and seconds in the normal time mode of operation as will be discussed in further detail hereinafter.

In FIG. 2, the display that is illustrated is meant to be a liquid crystal display, although other forms of display can also be used. The timing circuit chip 10 controls the display in accordance with the present invention to illuminate certain of the segments for providing proper time designations in connection with both digital and analog display. In FIG. 2 it is noted that with respect to the analog display that some of the segments as illustrated at 54 are longer. These are at five segment intervals, usually designating five minute intervals and the segments therebetween are shorter. This gives a visual indication of the five minute intervals.

Figure 3A:
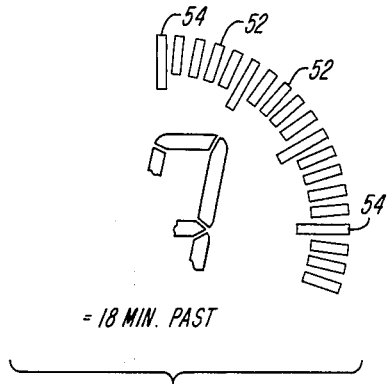
FIG. 3A shows a segment of the display of FIG. 2 for one type of display illustrating all segments being displayed up to the designated time.
Figure 3B:
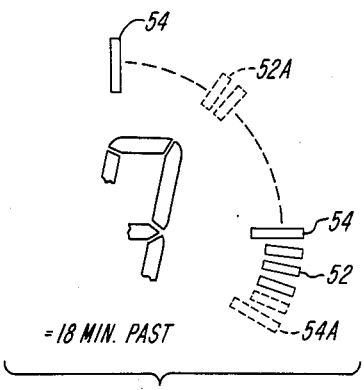
FIG. 3B is a fragmentary view of the same display of FIG. 3A but illustrating only a portion of the segments being displayed starting with a five minute interval segment and any other segments to be illuminated thereafter and indicating the proper time, such as the eighteen minute past designation illustrated.

Reference is now made to FIGS. 3A and 3B. Both of these diagrams are of portions of the display illustrated in FIG. 2. FIGS. 3A and 3B show two different ways that the display may be illuminated to indicate, for example, eighteen minutes past the hour. In FIG. 3A all eighteen of the segments are illuminated to indicate eighteen minutes past the hour. Alternatively, in FIG. 3B, as is preferred in accordance with the present invention, only four segments are illuminated. These segments include a main segment 54 which indicates fifteen minutes past the hour as well as three additional shorter length segments so that the total of segments illuminated indicate the desired eighteen minutes past the hour. The segments remaining in between as illustrated at 52A in FIG. 3B are not illuminated.

In accordance with the control of FIG. 3B, as the time progresses and the next segment is illuminated to indicate nineteen minutes past the hour, then, thereafter, when the next five minute interval segment is illuminated as illustrated at 54A in FIG. 3B then all of the other segments therebefore are extinguished. Thus, in accordance with the control depicted in FIG. 3B, upon reaching each of the five minute segments 54 any segment illuminated therebefore are extinguished and thereafter, segments are illuminated in order as indicated in solid outline in FIG. 3B until the next five minute segment such as the segment 54A is reached. At that time then the previous segments are extinguished. This operation continues about the entire analog display.

Figure 3C:
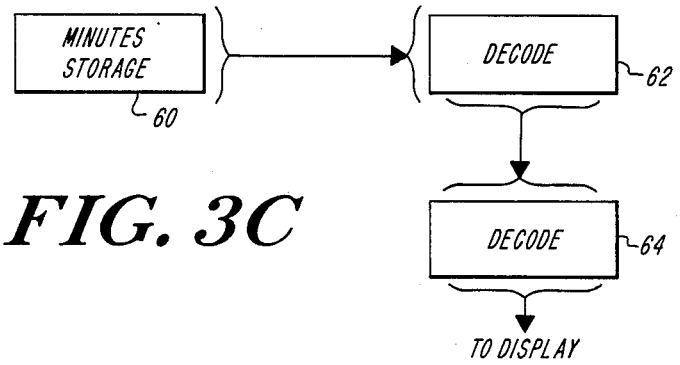
FIG. 3C is a block diagram useful in illustrating one of the control concepts of the present invention relating in particular to form of display illustrated in FIG. 3B.

In connection with the type of control that is used to provide the display of FIG. 3B rather than the display of FIG. 3A, reference is now made to FIG. 3C. In FIG. 3C there is shown the minutes storage as well as decoders 62 and 64. The minutes storage 60 represents the storage of a number that may be in digital or binary form indicating the desired minutes. For example, this may be the eighteen minutes depicted in FIGS. 3A and 3B. The decoder 62 has an output that selects all of the segments that are to be illuminated such as the series of segments depicted in FIG. 3A. However, there is in addition a further decoder 64 that provides the further decoding to select only the segments illustrated in solid in FIG. 3B. The output of this decode sequence then couples to the display to control the display in the manner discussed previously in connection with FIG. 3B. The decoder 64 operates on the basis of sensing a "new" segment 54 and then controlling previously illuminated segments to be extinguished but permitting subsequent segments 52 to be illuminated until the "next" segment 54 is reached. The type of logic and decoding for carrying this out is well within the knowledge of a person skilled in the art. Moreover, the decodes 62 and 64 illustrated in FIG. 3C are for the purpose of explanation it being understood that the circuit 10 depicted in FIG. 1 may be programmed to provide operation either as illustrated in FIG. 3A or as illustrated in FIG. 3B.

The form of operation illustrated in FIG. 3B has been described primarily in connection with the normal time mode of operation. However, the partial segment illumination concepts of FIG. 3B may also be applied in the count mode of operation.

Figure 4A:
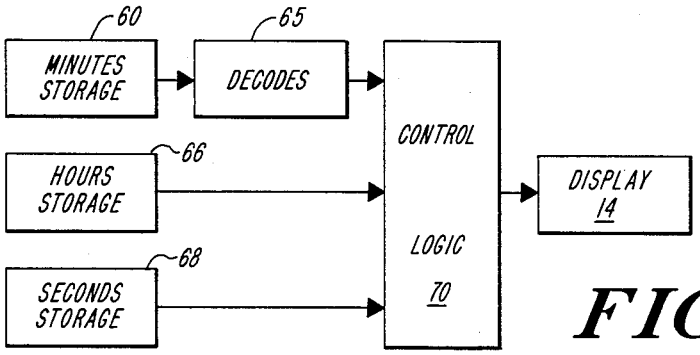
FIGS. 4A and 4B are block and logic diagrams, respectively, useful in illustrating a further feature of the present invention relating to the dual use of the analog display and the associated minutes designation and seconds sweep.
Figure 4B:
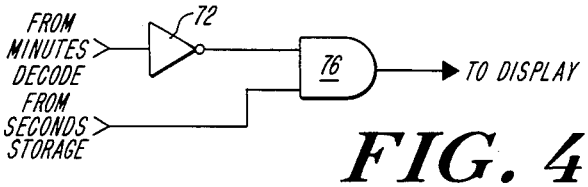

In accordance with a further feature of the present invention, reference may now be made to FIGS. 4A and 4B. These block and logic diagrams are illustrated for the purpose of explanation it being understood that, in the preferred embodiment of the present invention, the operation described is controlled in accordance with the programming of the circuit chip 10 of FIG. 1.

In the display illustrated in FIG. 2, as indicated previously, there is a digital display 40 and an analog display 50. In the normal time mode of operation the digital display 40 indicates hours while the analog display illustrates by means of its plural segments minutes. In the example given in FIG. 3B which is a time of 10:18 the fifteen minute segment 54 is illuminated as well as the three following segments and at the same time the digital display is illustrating the numeral "10". In accordance with a unique feature of the present invention, seconds are indicated by a seconds rate sweep of the segments 52, including the longer segments 54. In this regard, refer to FIG. 4A for an illustration of the minutes storage 60 as well as the decodes 65. There is also an hours storage 66 and a second storage 68. These couple to the control logic 70 which in turn couples to the display 14. Again, the control logic 70 illustrated in FIG. 4A is simply for the purpose of illustration it being understood that the programming of the circuit chip 10 carries out the proper level of control. FIG. 4B is a logic diagram of at least a portion of the control logic 70 that is used to provide the desired form of seconds sweep as in accordance with the present invention. The logic diagram of FIG. 4B includes an inverter 72 and an AND gate 76.

The operation of the display 14 of FIG. 4A is controlled by storage of numbers that are to be displayed. These numbers are controlled by the control logic 70 for control, in turn, of the display 14. The hours storage controls the digital display. The minutes storage with its associated decodes 65 is coupled to the control logic 70 along with the seconds storage 68. The minutes storage provides the basic selection which in the example given previously is illustrated in FIG. 3B. The hours storage indicates a "10" the minutes storage indicates an "18". The seconds storage is in essence an additive control that functions as follows. For the display sequence illustrated in FIG. 3B, the seconds selection will cause sequential illumination of each of the segments that are not illuminated by the minutes designation. Thus, segments such as 52A illustrated in FIG. 3B are illuminated in sequence. When the control reaches the fifteen minute segment 54, the logic interprets the this and instead of illuminating this segment, which is already illuminated, it turns the segment off. The same also occurs with the remaining three illuminated segments 52 illustrated in FIG. 3B. These are all turned off and then once these four illuminated segments are passed then the remaining segments are in turn pulsed to provide a sweeping action indicating seconds about the entire face of the time display.

Now, FIG. 4B as indicated previously is an illustration of the logic that carries out this sequential sweeping action of illumination of unselected segments and extinguishing of selected segments. It is noted that the input to inverter 72 is from the minutes decode and thus this is sensing whether a particular segment is illuminated or not. If the segment is not illuminated then the output of inverter 72 is high and gate 76 is enabled. Thus, for that particular segment, when there is a signal from the seconds storage this is past by way of gate 76 to the display to enable illumination of that particular segment which is the unselected segment as far as the minutes decode is concerned.

Now, if one of the four segments in the illustration of FIG. 3B is selected then the output of the inverter 72 is low and this inhibits gate 76 causing essentially an extinguishing of that particular segment, as the seconds illuminate the segments in sequence. Thus, it can be readily seen that with a display as illustrated in FIG. 2, even though there is essentially only a single digital display and a single analog display it is possible to illustrate not only hours and minutes but also seconds by virtue of essentially a dual use of the analog display.

Reference is now made to the drawings in connection with a description of the different modes of operation that can be carried out. In this regard, refer to the circuit diagram of FIG. 1 and the mode switch 20. This switch is operated in sequence to change from one mode to the next. In the embodiment disclosed herein there are four separate modes and these modes are selected in sequence by successive depression of the mode select switch 20. The modes that are described herein are the normal time mode, the alarm mode, the count down mode and the count up mode. These modes of operation are now described in association with the drawings illustrated herein.

NORMAL TIME MODE

When the mode select switch 20 is in this mode of operation the display illustrated in FIG. 2 displays, in the digital portion thereof, hours. The analog display 50 is for the display of minutes. In the normal mode of operation for a time of 10:18, the illustration of FIG. 3B applies. This illustrates the digital portion as being a "10" and the analog portion as indicating eighteen minutes past that hour.

In the normal time mode of operation if the time is to be set because the time is incorrect or for any other reason, then the switches 22 and 24 are also used. The switch 22 increments the hour by depression thereof and the switch 24 increments the minutes designation by successive depression thereof. Thus, in the normal time mode of operation the switches 22 and 24 can be used to set the proper time.

ALARM MODE

In this mode of operation the display is substantially the same as in the normal time mode of operation. In other words, the digital portion of the display displays hours and the analog portion of the display displays hours and the analog portion of the display displays minutes. The hours and minutes that are displayed indicate the time that one wishes an alarm to be set. It is noted that in this mode of operation the designation AL illustrated in FIG. 2 at 43 is illuminated. This simply indicates that one is in the alarm mode of operation.

In the alarm mode of operation the alarm is enabled when the start/stop button 18 is pressed. When this occurs a flag comes on as indicated at 45 in FIG. 2. Also the designation "PM" illustrated at 47 in FIG. 2 is enabled. Even though, in the normal time mode of operation the "PM" designation is not necessary, when setting the alarm this designation is necessary.

Now, when the system reverts to the normal time mode of operation with the alarm having been set, when the buzzer 30 illustrated in FIG. 1 sounds, the start/stop button 18 may be used to terminate the buzzer sound. Otherwise, the buzzer 30 is controlled to time out after five minutes. It is furthermore noted that the alarm continues to go off the same time each day, unless, in the alarm mode, the start/stop button is actuated so as to cease the alarm enabling.

COUNT DOWN MODE

The display of FIG. 2 may also be operated so as to function as a count down timer. When this mode is selected by actuation of the button 20, the display illustrates a "19" at the digital portion of the display and all of the perimeter segments 52 are also illuminated. In this mode of operation, the switch 22 may be operated to set the desired minutes digits. The switch 24 may be used to set the desired seconds per the analog display. In this mode of operation the timer is started by depressing the start/stop button 18.

When the timer times out the buzzer 30 sounds. The buzzer 30 can be terminated by pressing the start/stop button 18. If this button 18 is not depressed then the timer times out after a predetermined interval such as five minutes.

In this mode of operation, the timer can be started and stopped with the button 18. Once the timer has timed out the pressing of the button 18 resets the display to the previous timer setting.

It is noted in this mode of operation that the digital portion 40 of the display now illustrates minutes rather than hours and the analog portion 50 of the display now illustrates seconds rather than minutes. The timer can be set to a maximum of 20 minutes but by operation of the buttons 22 and 24 can be set essentially to any value up to 20 minutes and once set the timing can be initiated by way of the start/stop switch 18.

COUNT UP MODE

In this mode of operation the operation is essentially the reverse of the count down mode. When this mode is first initiated by depression of the switch 20, the display illustrates at the digital portion 40 a "0" and also illustrates at the analog portion 50 zero seconds. In this mode of operation the switches 22 and 24 do not have any effect upon the timer. The timer is adapted to not be preset.

The start/stop button 18 is used to start the up count. When the nineteen minute sixty second period is reached the buzzer 30 sounds. The termination of the buzzer sound can take place by actuation of the start/stop switch 18 otherwise the buzzer 30 times out in say five minutes.

Having now described a preferred embodiment of the present invention, it should be apparent to those skilled in the art that numerous other embodiments and modifications thereof are contemplated as falling within the scope of the present invention as defined by the appended claims.

What is claimed is:

1. A time display apparatus comprising;

a display means including means defining a digital display having two digits, and means defining an analog display comprised of a plurality of display segments disposed circumferentially about said digital display and used for the purpose of one of minute and second display, display control means including means for controlling the digits of the digital display, and means for controlling the plurality of display segments of the analog display, and manual selection mode means for controlling said display control means to provide at least two separate modes of control including a normal time mode in which the digital display registers hours and the analog display registers minutes, and a count mode in which the digital display registers minutes and the analog display registers seconds.

2. A time display apparatus as set forth in claim 1 wherein one of the digital display digits is for decimal display.

3. A time display apparatus as set forth in claim 2 wherein said one of the digital display digits is comprised of a seven-segment display.

4. A time display apparatus as set forth in claim 3 wherein the plurality of display segments number sixty.

5. A time display apparatus as set forth in claim 4 wherein twelve of the sixty display segments, at five segment intervals, are visually distinguishable from the remaining segments.

6. A time display apparatus as set forth in claim 5 wherein said visually distinguishable segments are longer than the remaining segments.

7. A time display apparatus as set forth in claim 1 wherein said means for controlling the analog display includes means, operable in the normal time mode, for sequentially illuminating the display segments at a seconds rate.

8. A time display apparatus as set forth in claim 7 further including means for only illuminating display segments at said seconds rate that are unselected by said minutes registration.

9. A time display apparatus as set forth in claim 8 further including means for extinguishing display segments at said seconds rate that are selected by said minutes registration.

10. A time display apparatus as set forth in claim 9 wherein said means for controlling the analog display includes means operable in the normal time mode, for illuminating the display segments at a minutes rate with five or fewer segments illuminated to indicate minutes.

11. A time display apparatus as set forth in claim 1 wherein the analog display comprises sixty display segments with twelve of the sixty segments, at five segment intervals, being visually distinguishable from the remaining segments.

12. A time display apparatus as set forth in claim 11 wherein said means for controlling the analog display includes means, operable in the normal time mode, for selecting only one of the twelve segments that indicate a five minute interval, and for selecting, in addition, remaining segments only after the selected segment to indicate between the five minute intervals.

13. A time display apparatus as set forth in claim 1 wherein said count mode includes a count up mode and a count down mode, respectively.

14. A time display apparatus as set forth in claim 13 including manual digital selection means operable to change the digital display under user control.

15. A time display apparatus as set forth in claim 14 including manual analog selection means operable to change the analog display under user control.

16. A time display apparatus as set forth in claim 15 including manual start/stop selection means operable to initiate the counting in the count mode.

17. A time display apparatus as set forth in claim 16 including alarm means providing an audible signal when the count has ended.

18. A time display apparatus as set forth in claim 17 wherein said manual selection mode means further includes an alarm mode in which an alarm time is set and enabled from said manual start/stop selection means.

19. A time display apparatus as set forth in claim 18 wherein said audible signal is generated when the alarm occurs and continues for a predetermined interval.

20. A time display apparatus as set forth in claim 19 wherein the audible signal can be terminated by the start/stop selection means.

* * * * *